US005685920A

United States Patent [19]

Tanaka et al.

[11] Patent Number: 5,685,920

[45] Date of Patent: Nov. 11, 1997

[54] ANNEALING SEPARATOR HAVING EXCELLENT REACTIVITY FOR GRAIN-ORIENTED ELECTRICAL STEEL SHEET AND METHOD OF USE THE SAME

[75] Inventors: Osamu Tanaka; Maremizu Ishibashi; Tsuyoshi Hamaya; Tsutomu Haratani; Tomoji Kumano; Koji Yamasaki; Akira Sakaida; Chihiro Sakurai; Hotaka Honma, all of Kitakyushu, Japan

[73] Assignee: Nippon Steel Corporation, Tokyo, Japan

[21] Appl. No.: 440,276

[22] Filed: May 12, 1995

[30] Foreign Application Priority Data

| | | | |
|---|---|---|---|
| May 13, 1994 | [JP] | Japan | 6-099974 |
| Jul. 21, 1994 | [JP] | Japan | 6-169377 |
| Nov. 16, 1994 | [JP] | Japan | 6-282292 |
| Nov. 16, 1994 | [JP] | Japan | 6-282293 |
| Nov. 16, 1994 | [JP] | Japan | 6-282294 |
| Dec. 13, 1994 | [JP] | Japan | 6-309163 |

[51] Int. Cl.[6] ..... H01F 1/18

[52] U.S. Cl. ..... 148/113; 148/27; 148/28

[58] Field of Search ..... 148/27, 28, 113

[56] References Cited

U.S. PATENT DOCUMENTS

| | | | |
|---|---|---|---|
| 4,207,123 | 6/1980 | Reynolds et al. | 148/27 |
| 4,367,101 | 1/1983 | Huselkorn et al. | 148/113 |
| 4,496,399 | 1/1985 | Huselkorn et al. | 148/28 |
| 4,512,823 | 4/1985 | Howe et al. | 148/113 |
| 4,543,134 | 9/1985 | Tanaka et al. | 148/113 |
| 5,192,373 | 3/1993 | Wright et al. | 148/27 |
| 5,507,883 | 4/1996 | Tanaka et al. | 148/113 |
| 5,512,110 | 4/1996 | Yoshitomi et al. | 148/113 |

FOREIGN PATENT DOCUMENTS

| | | | |
|---|---|---|---|
| 232537 | 8/1987 | European Pat. Off. . | |
| 272867 | 6/1988 | European Pat. Off. . | |
| 305966 | 3/1989 | European Pat. Off. . | |
| 62-156226 | 7/1987 | Japan . | |
| 2-267278 | 11/1990 | Japan . | |
| 5-247661 | 9/1993 | Japan . | |
| 6-93335 | 4/1994 | Japan | 148/113 |
| 0607851 | 5/1978 | U.S.S.R. | 148/27 |

OTHER PUBLICATIONS

Patent Abstracts of Japan, vol. 15, No. 27 (C–797), Jan. 22, 1991 & JP–A–02 267278 (Nippon Steel, et al.), Nov. 1990.

Patent Abstracts of Japan, vol. 18 No. 4 (C–1149), Jan. 6, 1994 & JP–A–05 247661 (Nippon Steel, et al.), Sep. 24, 1993.

*Primary Examiner*—John Sheehan

*Attorney, Agent, or Firm*—Kenyon & Kenyon

[57] ABSTRACT

Disclosed is an annealing separator for production for grain-oriented electrical steel sheet, containing one or more compound selected from the following general formula;

$$[Mg_{1-x}M^{3+}{}_{x}]O \quad [Mg_{1-x}M^{2+}{}_{x}]O \text{ or } [Mg_{1-x}M^{2+}{}_{x1}M^{3+}{}_{x2}]O$$

where $M^{2+}$ is at least one bivalent element selected from the group consisting of Be, Ca, Ba, Sr, Sn, Mn, Fe, Co, Ni, Cu, Zn;

$M^{3+}$ is at least one tervalent element selected from the group consisting of Al, Fe, Cr, Co, B, Ti, Sb;

$0.01 \leq x \leq 0.40;\ x = x1 + x2$

This annealing separator having a lower melting point and higher degree of reactivity is applied on the decarburization annealed strip, and improves the properties of the glass film, especially uniform film appearance and good sealing effect, and magnetic properties.

15 Claims, 3 Drawing Sheets

●: (A) SOLID SOLUSION METALLIC OXIDE COMPOUND (PRESENT INVENTION 4 OF EXAMPLE 2) 100g+$TiO_2$ 5g
◎: (B) SOLID SOLUSION METALLIC OXIDE COMPOUND 100g (PRESENT INVENTION 4 OF EXAMPLE 2) +$MnCl_2$ (Cl:0.04%)+$Na_2B_4O_7$ 0.3g+$TiO_2$ 100g
○: (C) CONVENTIONAL MgO (COMPARATIVE EXAMPLE 1) 100g+$TiO_2$ 5g
SAMPLE: MATERIAL OF EXAMPLE 8

ANNEALING SEPARATOR HAVING EXCELLENT REACTIVITY FOR GRAIN-ORIENTED ELECTRICAL STEEL SHEET AND METHOD OF USE THE SAME

BACKGROUND OF THE INVENTION

1. Field of the Invention

The present invention relates to a process for the production of a grain-oriented electrical steel sheet used as an iron core of an electric appliance, i.e., a transformer. More particularly, the present invention relates to an annealing separator having excellent reactivity, which provides a glass film having a uniform thickness and an improved magnetic properties for a grain-oriented electrical steel sheet and its use.

2. Description of the Prior Art

In a typical process for production of a grain-oriented electrical steel sheet, a strip containing Si in amount of less than 4.0% is hot rolled. Then, one step cold rolling with hot rolled band annealing or two step cold rolling with intermediate annealing is carried out to reduce the final thickness. The thus obtained cold rolled strip is decarburization annealed in a wet hydrogen/nitrogen mixed atmosphere (75% of $H_2$ and 25% of $N_2$) or dry hydrogen atmosphere (100% of $H_2$) under the controlled the dew point ($PH_2O/PH_2$) for decarburizing, primary recrystallization and forming an oxide film mainly containing $SiO_2$.

Then, the annealing separator mainly containing MgO is applied, in the form of a slurry obtained by dispersion in water, to the steel sheet by means of spraying or roll squeezing after decarburization annealing, and the final annealing for the secondary recrystallization, purification and forming glass film is carried out. Thereafter, an insulation coating is applied which generates surface tensioning effects, and heat flattening and baking are carried out in a continuous annealing line. The preceding process can be used in the case of production of thin gauge high permeability grain-oriented electrical steel sheet having a thickness of less than 0.27 mm.

Magnetic domain control refining treatment is conducted for applying partial or linear strains to the steel surface by scratching with laser-beam irradiation, pressing with gear rolls, chemical etching and other mechanical or non-contact scratching means for reducing the iron loss.

Grain-oriented electrical steel sheet is composed of crystal grains having a Goss orientation having a <001> axis in the rolling direct on the {110} plane [usually expressed as orientation {110}<001> by Miller indices]. This {110}<001> texture having <001> axis preferentially promotes grain growth during a secondary recrystallization annealing. The commercial production of the grain-oriented electrical steel sheet uses this phenomenon. It is well known that (110) texture, having low surface energy, is preferentially develops and graw to erode other crystal grains which inhibits the grain growth the normal grains by pinning the grain boundary migration of primary recrystallization grains by such as AlN and MnS, so called inhibitors which finely dispersed in the steel, during this secondary recrystallization step. Accordingly, controlling both the dispersion of AlN and MnS and the dissolution into the steel sheet is very important in the production of superior grain-oriented electrical steel sheet products.

It is well known that the change of inhibitors in the final annealing is greatly affected by an oxide film and annealing separator which is formed during decarburization annealing, and by the conditions of the heating cycle and the atmosphere during final annealing. More specifically, the characteristics of MgO and its additives as an annealing separator are very important factors and exert a great influence on factors such as starting temperature of the glass film formation, its formation speed, the quality of its film and an the characteristics of MgO and additives. MgO in the annealing separator act on oxide film comprising $SiO_2$ which is formed in the decarburization annealing, and forms a glass film containing mainly forsterite ($2MgO+SiO_2=Mg_2SiO_4$). In the course of glass film formation using the conventional MgO powder, the characteristics of MgO, which are its particle size, its purity, activity, and other factors such as dispersibility in water, an amount of hydration, the coating weight, uniformity of the coating film and an adherability to the steel sheet, greatly influence a control the chemical reactions which occur during a glass film formation. Furthermore, the kind of additives which are added to MgO to accelerate the chemical reaction, the amount of additives, and their dispersion on the surface of MgO and on the surface of the steel sheet also greatly influence the starting temperature of the glass film formation, its formation speed, and the amount of film formed in the course of the glass film formation.

A variation of the characteristics of MgO in an annealing separator will effect the glass film properties and the magnetic properties in the resultant final products.

MgO which is used as an annealing separator is generally obtained from such materials as magnesium hydroxide, magnesium carbonate and basic magnesium carbonate. These materials are treated to form fine crystal grains having an average particle size of from several hundreds Å to several thousand Å, then further treated by calcination at a high temperature, for example 700°–1200° C. Thus, fine particles of MgO sized from 0.2–5 μm can be obtained. Usually, this MgO contains various kind of additives for accelerating the chemical reaction during the glass film formation. Then, these MgO and additives are suspended in water to make slurry, penetrated and dispersed by which equipped penetrating means in a tank, such as propeller blades or shears, depending upon the chemical composition and the processing steps used.

During the above processing, aggregations of particles can occur because of secular distortion by moisture absorption from sintering and calcination in the slurry production to use and because of strong aggregation action among particles during suspension in water, thereby the MgO and additive particles become large, for example from several microns to several tens of microns, having a detrimental effect on the chemical reactions during the coating step. The conventionally used MgO is specifically required to calcinate at a high temperature when MgO having a low hydration is required, and it tends to intensity the sintering and aggregation of MgO.

As a result, various defects occur, such as decrease the contact area among MgO particles, decrease the density of a coating film, decrease the adhesion to the steel sheet surface, and decrease the uniformity of coating film, on the surface of the steel sheet after the coating and drying step.

Under these circumstances, the slurry viscosity deteriorates, in addition to deteriorating the high speed coating operation and the attending difficulties in obtaining a uniform coating thickness. In the case of using a mixture of additives to accelerating the chemical reaction of MgO to form the glass film, these additives themselves tend to aggregate in a slurry or sintering process giving rise to coarse particles is a coating film or oxide film on a steel sheet surface. Especially, this phenomenon becomes more conspicuous when he above-mentioned additives are added to MgO which has strong aggregation characteristics in itself. As a result, acceleration of a chemical reaction will be weakened, and uneven action will also occur. Therefore, it is difficult to obtain a uniform and high quality glass film without deterioration of the magnetic properties. Considering these matters, it is very important to develop a glass film having the characteristics of high dispersibility and reactivity.

One technique for production of an annealing separator containing MgO having high reactivity using activation treatment of the outermost surface layer of MgO particles was proposed in Japanese Unexamined Patent Publication (Kokai) No. Sho 62-156226 which was invented by the present inventors.

In this method, a product having increased uniformity of glass film and improved magnetic properties is obtained by a process which forms a $Mg(OH)_2$ hydration layer to the outermost surface layer of MgO particles obtained by high temperature calcination in the MgO production step. Another method is proposed in Japanese Unexamined Patent Publication (Kokai) No. Hei 02-267278, that annealing separator containing 0.8–2.5% of OH chemical adsorption layer on MgO particle surface based on an amount of MgO calculated in terms of $H_2O$ which calcinated MgO treated in atmosphere containing vapor above 100° C., subsequent to coating on a decarburized steel sheet and to final annealing. In this publication, it is mentioned that a product having increased uniformity of glass film and improved magnetic properties is obtained. Japanese Unexamined Patent Publication (Kokai) No. Hei 05-247661 describes formation of a uniform amount of $SiO_2$ surface layer during the decarburizing step, and obtaining extreme fine particle and activation for the particle surface in the slurry production step.

These prior technologies resolve the problems of MgO particle aggregation in the production of annealing separator, which changes the MgO surface after final annealing by a specific surface treatment at a high temperature, which changes the MgO surface and gives rise to fine particles by fine particle production technology.

Accordingly, a forsterites forming reaction is increased by reducing the surface energy improving the compatibility with water, and forming a certain thickness of an OH layer on the MgO particle surface layer. According to these effects, an MgO coating is applied to the steel sheet surface in a more finely dispersed condition than that conventionally obtained, and also the reactivity is further improved in a glass film formation.

However, these prior technologies do not completely solve the problems of sintering caused by the conditions of MgO production, stability of the OH chemical adsorption layer, and aggregation caused by secular distortion in MgO production and its use. There also remain the problems of the glass film depending upon qualities of the oxides film which formed during decarburization annealing. Therefore, it is strongly desired to develop and further improve production of MgO having a lower hydration rate and higher reactivity.

The technical object of the present invention is to solve the above-mentioned problems.

SUMMARY OF THE INVENTION

A primary object of the present invention is to obtain a high quality annealing separator which can overcome the technical problems which are desired to improve the reactivity and low melting point during formation of glass film with conventionally used MgO, at the coating step of an annealing separator in the production of grain-oriented electrical s eel sheet products.

The present inventors researched way of overcoming the defects of the conventional techniques and attaining the foregoing object, which is a more effective production process for obtaining a more uniform glass film, through glass film formation step, decarburization annealing step and final annealing step. In this research, the present inventors mainly studied the reactivity of MgO used as an annealing separator, and found that a MgO compound is obtained in which other bivalent and/or bivalent metallic elements replace a part of Mg and is solid solution in MgO. Use of this compound results in a sharply lowered melting point with low hydration, and this leads to a great improvement of the glass film characteristics having uniformity and stable reactivity in the final annealing, by lowering the temperature to form a glass film.

As a result, it is possible to obtain excellent glass film forming effects with high film tension, high adhesion and high uniformity accompanying the other sealing effect, of a slurry on the steel sheet during a step of glass film formation, and the resultant product shows superior magnetic properties and has stable inhibitors, such as AlN, MnS.

MgO used as an annealing separator is usually produced by a method such as a method of extraction from bittern or from sea water. The former is that $Mg(OH)_2$ is obtained by a chemical reaction with $Ca(OH)_2$ which treated with $MgCl_2$. The latter is that $Ca(OH)_2$ is directly reacted with sea water to obtain $Mg(OH)_2$, followed by calcination. It is well known to use some kinds of additives as accelerating agents, such as Ti compounds. With these conventional techniques, the MgO characteristics affect not only the formation of the glass film, but also greatly influence the magnetic flux density and iron loss. Therefore, it is very important to utilize the supplemental effects caused by additives because of certain limitation in the MgO production to achieve a stable glass film formation.

More specifically, in accordance with the present invention, there is provided an excellent annealing separator containing a new compound which comprises a solid solution metallic oxide compound of MgO which other bivalent and/or bivalent metallic elements replace a part of the Mg.

More specifically, in accordance with the present invention, there is provided an excellent annealing separator with a high degree of reactivity for the grain-oriented electrical steel product and its use, which comprises an annealing separator containing one or more compound selected from following general formulas;

$$[Mg_{1-x}M^{3+}{}_{x}]O,\ [Mg_{1-x}M^{2+}{}_{x}]O \text{ or } [Mg_{1-x}M^{2+}{}_{x1}M^{3+}{}_{x2}]O$$

where $M^{2+}$ is at least one bivalent element selected from the group consisting of
Be, Ca, Ba, Sr, Sn, Mn, Fe Co, Ni, Cu, Zr and $M^{3+}$ is at least one bivalent element selected from the group consisting of
Al, Fe, Cr, Co, B, Ti, Sb and x is defined by $0.01 \leqq x \leqq 0.40$ and $x=x1+x2$ The above-mentioned metallic oxide compound contains a certain amount of additional metallic oxide compounds, such as one or more of F, Cl , Br, $Co_3$, $SiC_3$, $PO_3$, $CrO_3$ and other additives such as one of sulfate, sulfide, borate, chloride, oxide; and also have certain characteristics such as a specific surface area of 15–200 $m^2/g$ and a CAA value of 30–500 seconds at 30° C.

Furthermore, the present invention also provides, a method for use of the annealing separator thus obtained the metallic oxide compound is applied to the decarburized steel sheet surface in the ordinary production process which comprises performing cold-rolling once or twice with intermediate annealing to obtain a final thickness, performing decarburization annealing in a wet or mixed hydrogen atmosphere, forming an oxide film mainly containing $SiO_2$, applying an annealing separator mainly containing MgO, and performing a final annealing for a secondary recrystallization and purification of the steel sheet.

Moreover, according to the present invention, in the production of grain-oriented electrical steel sheet, a lower melting point of the MgO, a lower glass film formation temperature and a uniform stability of reaction can be achieved.

Especially, when using the above described annealing separator containing the new compound which is a solid solution metallic oxide compound of MgO with other bivalent and/or bivalent metallic elements replace a part of the Mg, significant effects which are a sharply lower melting point of glass film formation and uniformity of reaction in the glass film can be achieved.

Therefore, high quality glass film is obtained under various conditions in the course of oxide film formation during decarburization annealing and glass film formation during a final annealing.

Therefore, the resultant product shows significantly improved magnetic properties because of other sealing and tensioning effects brought about by these films.

Figure 1:
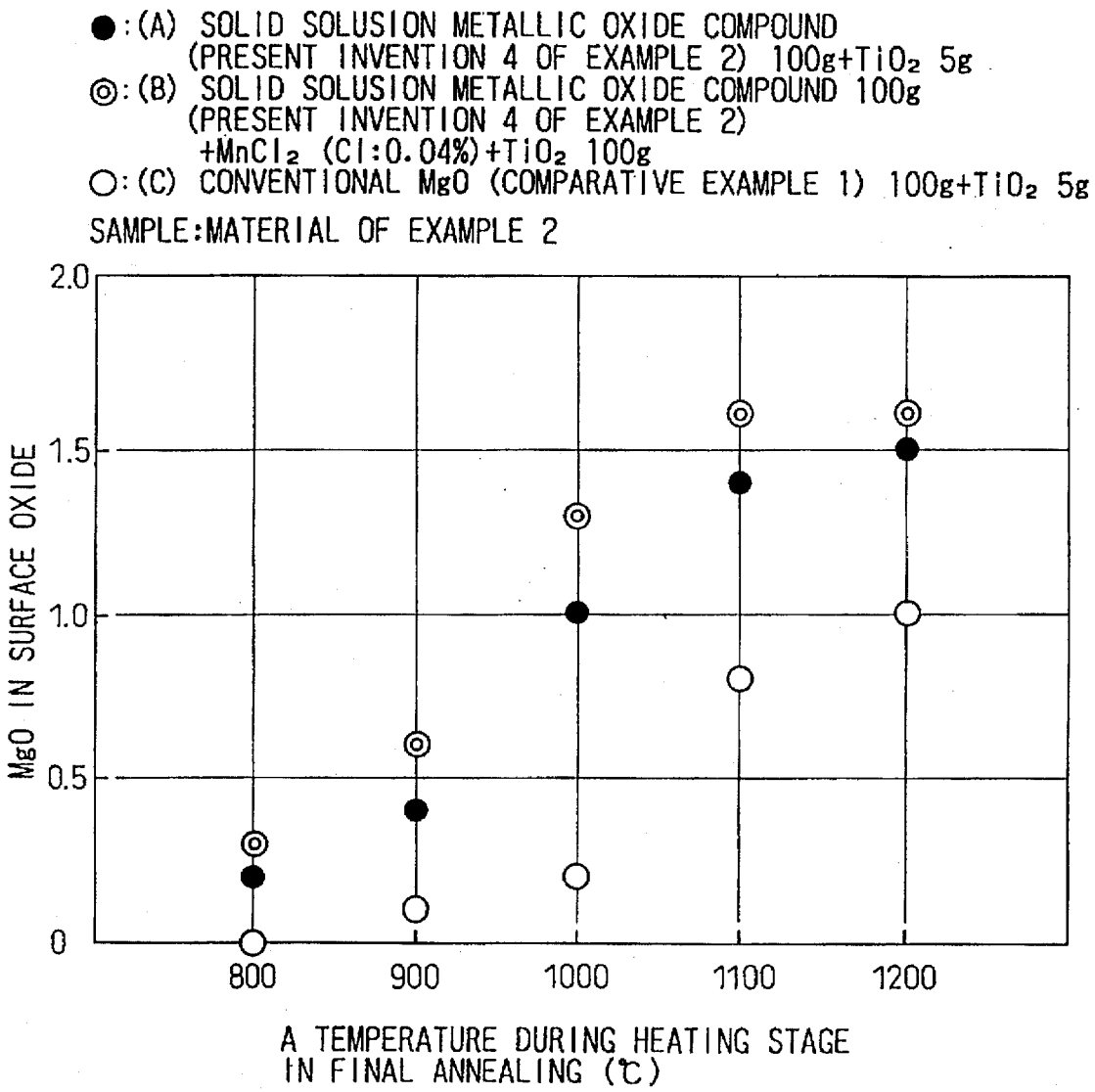
FIG. 1 is a diagram illustrating the analyzed results of glass film formation performance in the case of (A) solid solution metallic oxide compound [Present Invention 4 in Example 2], (B) $MnCl_2$ containing this metallic oxide compound of (A), and (C) conventional MgO [Comparative Example 1 in Example 2], which are used as an annealing separator.

According to FIG. 1, glass film is formed at low temperature in a course of heating stage of final annealing, and the thickness of glass film which was finally obtained was much greater than that of the Comparative Examples.

Figure 2:
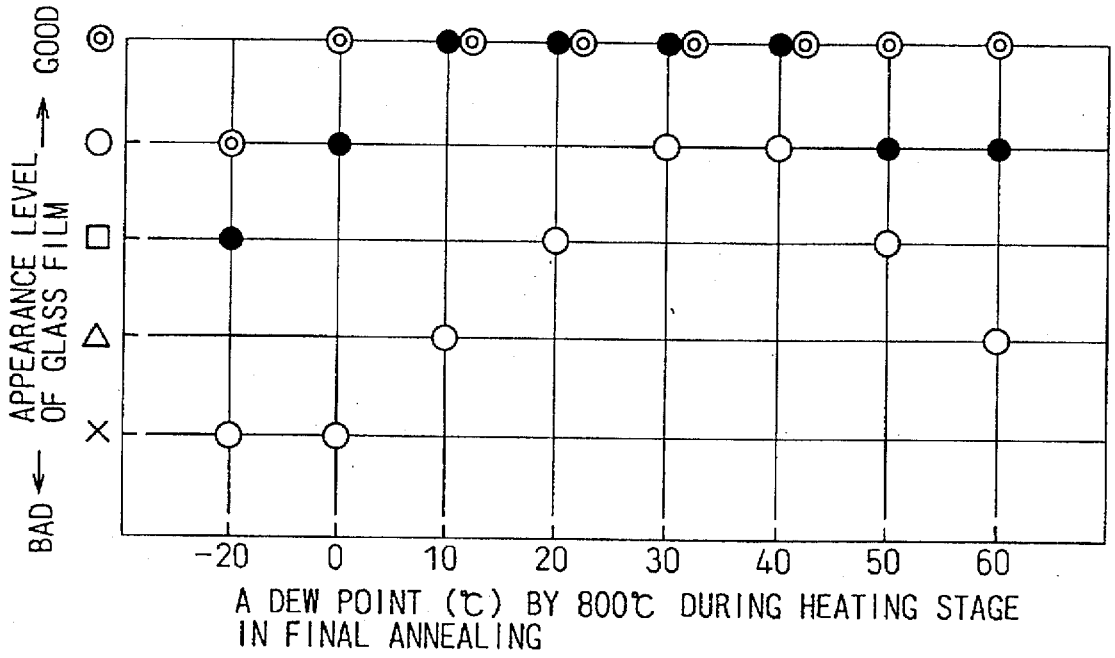

FIG. 2 is a diagram illustrating the relationship between the dew point of a gas atmosphere and the appearance level of glass film formation with varied annealing separators in the different samples.

Figure 3A:
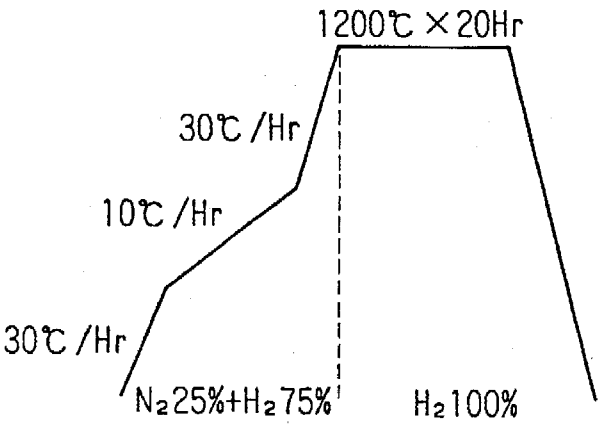
Figure 3B:
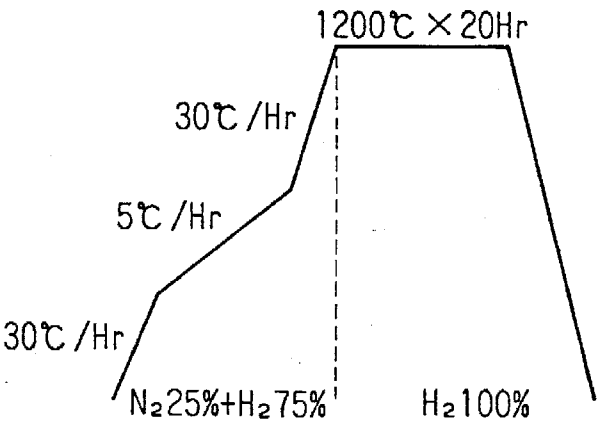
Figure 3C:
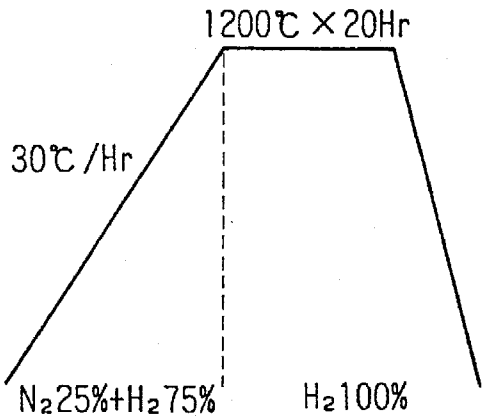

FIGS. 3(A), 3(B) and 3(C) are heat diagrams showing the different heating conditions in heating stage during the final annealing in the Example 8.

DESCRIPTION OF THE PREFERRED EMBODIMENTS

The annealing separator used in the present invention contains a novel compound which comprises a solid solution metallic oxide compound of MgO in which other bivalent and/or bivalent metallic elements replace a part of Mg. The above-mentioned solid solution metallic oxide compound is produced as follows; first the crystal structure is produced in the form of a stratiform structure which comprises a positively charged basic layer to brucite [$Mg(OH)_2$] and a negatively charged intermediate layer composed of anions and water between the above basic layer and intermediate layer.

The amount of positive electric charge depends upon the replaceable amount. Accordingly, electric neutrality of a whole crystal is maintained by neutralizing the positive charge with the anions of the intermediate layers. The remaining space filled with water between the layers other than the intermediate anion layer. Thus, a solid solution of metallic oxide hydroxide is obtained.

For example, an alkali is added to a mixed solution of $M^{2+}$, $M^{3+}$, and $A^{n-}$ such as $OH^-$, $F^-$, $Cl^-$, $Br^-$, $CO_3^-$, $SO_4^-$, $SiO_3^-$, $HPO_4^-$, $CrO_4^-$, $Fe(CN)_6^{3-}$, etc. And allowed to react at a pH of more than 7. Thereafter, this solid solution metallic hydroxides compound is calcinated in a rotary kiln, batch furnace or other apparatus at a high temperature of from 700° to 1000° C. at a cot trolled calcination temperature and time appropriate for obtaining a solid solution metallic oxide compound. The thus obtained solid solution metallic oxide compound shows a lower melting point because of the solid solute materials. On the other hand, anions, added as necessary, can be maintained in a proper amount in the final product of the solid solution metallic oxide compound depending upon the treatment conditions.

Therefore, high reactivity is produced by combining melting point reduction effect of the solid solution oxide compound with the melting point reduction effect of the appropriately remaining anion (Ay).

Moreover, the solid solution oxide compound containing Fe shows a very significant effects in lowering the temperature of glass film formation. As a result, it is possible to obtain both a high reactivity and a lower melting point, which cannot be achieved by a conventional simple substance of an oxide or mixed oxides in MgO . According to the above-mentioned effects, glass film forming reactivity starts at remarkably lower temperature in the final annealing. Furthermore, instability or loss of inhibitors, such as AlN and MnS etc. can be avoided, by the sealing effect of the film itself, and a crystal structure having a proper texture, which prevents loss of the inhibitor from at heating stage to at high temperature maintaining stage during secondary recrystallization.

In addition, the finally obtained glass film shows uniform, good adhesion and high tension characteristics, and excellent iron loss is obtained together with high permeability.

In the present invention's solid solution metallic oxide compound, there is no need to add accelerating agents as additives such as sulfate, sulfide, borate, chloride and oxide, etc. to promote reactivity.

However, a higher quality glass film and more stable magnetic properties can be obtained by means of addition by the above-mentioned accelerating agents under disadvantageous conditions such as adjustment of steel compositions, decarburization annealing and final annealing etc.

As an accelerating agents, among the halides of F, Cl and Br, halides of Cl show especially good results. These halides lower the melting point as do the anions contained in the solid solution metallic oxide compound, and stabilize the glass film characteristics and magnetic properties.

The annealing separator provided by the present invention is comprised of one or more of the following solid solution metallic oxide compounds 1, 2 or 3 which are represented by the following general formulas;

$$[Mg_{1-x}M^{3+}_{x}]O,\ [Mg_{1-x}M^{2+}_{x}]O \text{ or } [Mg_{1-x}M^{2+}_{x1}M^{3+}_{x2}]O \qquad 1$$

where $M^{2+}$ is at least one bivalent element selected from the group consisting of Be, Ca, Ba, Sr, Sn, Mr, Fe, Co, Ni, Cu, Zn;

$M^{3+}$ is at least one tervalent element selected from the group consisting of Al, Fe, Cr, Co, B, Ti. Sb;

where x is defined by $0.01 \leqq x \leqq 0.40$ and x=x1+x2

$$[Mg_{1-x}M^{3+}{}_{x}]O.Ay,\ [Mg_{1-x}M^{2+}{}_{x}]O.Ay \text{ or } [Mg_{1-x}M^{2+}{}_{x1}M^{3+}{}_{x2}]O.Ay \quad 2$$

where $M^{2+}$ is at least one tervalent element elected from the group consisting of Be, Ca, Ba, Sr, Sn, Mn, Fe, Co, Ni, Cu, Zn;

$M^{3+}$ is at least one tervalent element selected from the group consisting of Al, Fe, Cr, Co, B, Ti, Sb;

where x is defined by $0.01 \leqq x \leqq 0.40$ and x=x1+x2;

A is at least one of the following

F, Cl, Br, $CO_3$, $SiO_3$, $PO_3$, $CrO_3$;

where y is defined by $0.001 \leqq y \leqq 2.0$ (parts by weight of y relative to 100 parts by weight of solid solution metallic oxide compound)

$$[Mg_{1-x}X^{a}{}_{x1}X^{b}{}_{x2}]O.Ay$$

where $X^{a}$ is $Fe^{2+}$ and/or $Fe^{3+}$ $X^{b}$ is $M^{2+}$ and/or $M^{3+}$ $M^{2+}$ is at least one tervalent element selected from the group consisting of Be, Ca, Ba, Sr, Sn, Mn, Fe, Co, Ni, Cu, Zn;

$M^{3+}$ is at least one tervalent element selected from a group consisting of

Al, Fe, Cr, Co, B, Ti, Sb;

A is at least one of the following

F, Cl, Br, $CO_3$, $SiO_3$, $PO_3$, $CrO_3$;

and y is defined by $0.001 \leqq y \leqq 2.0$ (parts by weight of y relative to 100 parts by weight of solid solution metallic oxides compound)

According to the present invention, 1) bivalent metallic element, 2) bivalent and tervalent metallic element, or 3) tervalent metallic element replace a part of the Mg. In the above bivalent or tervalent metallic element, $M^{2+}$ is a bivalent element of Be, Ca, Ba, Sr, Sn, Mn., Fe, Co, Ni, Cu and/or Zn, and $M^{3+}$ is tervalent element of Al, Fe, Cr, Co, B, Ti, Sb. The replaceable ratio may be determined by $0.01 \leqq x \leqq 0.40$ and x=x1+x2. The above bivalent or tervalent metallic element in the solid solution metallic oxide compound contains a metallic oxide compound which include several elements selected from those bivalent or tervalent metallic elements in MgO. If the replaceable metallic elements are selected from above-mentioned metallic elements, a lower melting point can be obtained in the present invention's solid solution metallic oxide compound which is replaced by metallic elements compared to bear MgO.

The annealing separator additionally contains at least one of sulfate, sulfide, borate, chloride or oxide in an amount of 0.05–10 parts by weight and/or at least one of halides as Cl, F or Br in an amount of 0.05–0.120 parts by weight relative to 100 parts by weight of the above solid solution metallic oxide compound as additives for accelerating the reaction. Those additives may be added during the production of the above solid solution metallic oxide compound or the preparation of the slurry state of the annealing separator. At least one of an alkali metal, or alkaline earth metal can be added at 0.01–0.50 part by weight to the above compound. The halide can be a metallic compound selected from halides of Li, Ba, Ti, V, Ta, Cr, Mo, W, Mn, Fe, Co, Ni, Cu, Zn, Ag, Cd, Al or Sn. It is possible to use other halides, such as at least one of hydrochloric acid, chloric acid, perchloric acid, or an oxychloride.

The above described solid solution metallic oxide compound has certain characteristics such as a specific surface area of 15–200 $m^2/g$ and a CAA value of 30–500 seconds at 30° C.

The amounts of other metallic element replacing the Mg is in a range of 0.01–0.40 atomic percent. If the amount of other metallic element is less than 0.01 atomic percent, it is not effective in lowering the melting point or improving the a glass film and magnetic properties. If the above amount is more than 0.40 atomic percent, peroxide film defects occur in melting point and reactivity. The most preferable range is 0.03–0.25 atomic percent. However, there is no specific limitation if the replaceable range of dissolved metal complexed bivalent or tervalent metallic element is within the range of 0.01–0.4 atomic percent.

Superior results can be obtained with the oxide compound of the present invention if $Fe^{2+}$ and/or $Fe^{3+}$ is contained in the range of 0.01–0.20 atomic percent as a part of metallic Mg. It is clear that Fe dissolved in MgO generates a significant reactivity effect, which is not observed for other metallic elements. It is considered that the reduction of the melting point caused by the Fe compound in the oxide film reacting with MgO and $SiO_2$, works together with the reduction of the melting point by the solid solution oxides compound, and with the acceleration of the glass film formation by the Fe compound. If the content of $Fe^{2+}$ and/or $Fe^{3+}$ is less than 0.01 parts by weight, it shows only a minor improvement in the reactivity, even if an addition of the solid solution compound. On the other hand, if the content of $Fe^{2+}$ and/or $Fe^{3+}$is more than 0.02 atomic percent, the melting point reduction is too strong, and peroxide film defects easily occur, depending upon the conditions of decarburization and final annealing. The replaced and dissolved metal for Fe are above described $M^{2+}$ and/or $M^{3+}$ elements. The proper amount of these replaced and dissolved elements generates a preferable improvement of reactivity by replacement and stabilization of powder. These dissolved metal convert to a spinnel composition in the glass film after reaction was accelerated and leads to contribute the high tension effect in the glass film.

The ratio of $M^{2+}$ and $M^{3+}$ elements is determined by the formulas $0.01 \leqq x \leqq 0.40$ and $0.01 \leqq x1 \leqq 0.02$ (X=x1+x2, x2 =at least one element selected from $M^{2+}$and $M^{3+}$ other than $Fe^{2+}$ and/or $Fe^{3+}$. If the replaceable ratio is more than 0.4, film defects occur for the same reason as in the case of replacement of Fe more than 0.20 of Fe. An anion is also present to increase the reactivity further. The anion can be at least one of element or compound selected from F, Cl, Br, $CO_3$, $SiO_3$, $PO_3$ or $CrO_3$. The anion is present in a ratio (y) of 0.001–2.0 per 100 parts by weight of the oxide compound. If y is less than 0.001 part by weight, the results are poor. On the other hand, if (y) is more than 2.0, peculiar film defects such as bare spots or scales which are caused by peroxidation are easily generated. It is difficult to obtain stable film quality in a final annealing, or the required magnetic properties.

Furthermore, the present invention's solid solution metallic oxide compound has a specific surface area generated by the fine particles' diameter and activity (CAA).

More specifically, ultra fine oxide crystals are obtained in case of an Mg compound containing dissolved Fe. The specific surface area is generally 10–15 $m^2/g$ in the conventional MgO. The present invention is characterized by an Mg compound having a large specific surface area, which is not obtainable in the conventional MgO. Therefore, a grain-oriented electrical steel sheet product having excellent film quality and magnetic properties, because of increased reactivity in the glass film formation can be obtained.

The preferable range of the specific surface area is 15–200 $m^2/g$, and an ultra fine metallic oxide compound having 30–200 $m^2/g$ is obtained by the present invention. If this specific surface are is less than 15 $m^2/g$, acceleration of reactivity effect by the metallic oxide compound is small. Specific surface area of more than 200 $m^2/g$ are difficult to produce stably in industrial scale. It also difficult to control a viscosity of slurry and control the amount of hydration in coating line.

It is important to control the hydration in the solid solution metallic oxide compound of the present invention. From this point of view, the CAA value is preferably 30–250 seconds at 30° C. If this value is less than 30 seconds, it is difficult to control the hydration amount, or to obtain a stable powder and slurry. On the other hand, if the above value is more than 250 seconds, decreased reactivity cannot be avoided, even when using the highly reactable metallic oxide compound of the present invention. It difficult to obtain a stable glass film formation based on sintering and calcination and to produce spinnel structure, and to expect sealing effect for surface area.

The solid solution metallic oxide compound of the present invention shows an excellent reactivity by itself, and there is no need to use reactable accelerating additives, as must be done with conventional MgO. However, when the present invention's solid solution metallic oxide compound is applied to grain-oriented silicon steel sheet as an annealing separator, at least one compound selected from sulfates, sulfides, borates, chlorides or oxides can be used as a supplemental accelerating agent according to the steel composition or steel sheet thickness. These supplemental accelerating agents are added in the range of 0.01–10 parts by weight relative to 100 parts of the above metallic oxide compound. If this amount is less than 0.01 parts by weight, the acceleration effect is poor. If this amount is more than 10 parts by weight, bare spot, scale and gas-mark-like defects peculiar to the peroxidation reaction are generated. According to the present invention, the role of the above supplemental accelerating agents is smaller than that of the conventional additives in MgO because of the significant reactivity of the present invention's solid solution metallic oxide compound. However, stable and increased reactivity matching the high reactivity brought about by the solid solution metallic oxide compound itself, and also to obtain stable and increased reactability in a dry or wet atmosphere at the final annealing can be obtained, if the proper additive and its amount are selected.

It is effective to use halogen compound of F, Cl, Br. etc., as additives in the present invention. If maintained anion group exists in a metallic oxide compound production, a total amount of anion group must be controlled. The total amount of one more of F, Cl, Br is 0.015–0.120 parts by weight relative to 100 parts by weight of the metallic oxide compound If the amount of the above halogen compound is less than 0.015 parts by weight the resulting acceleration of the glass film formation is insufficient. On the other hand, if the amount of halogen compound is more than 0.120 parts by weight, film thickness decrease and generate unevenness or spangle defects by peroxidation according to decarburization or final annealing conditions, and an etching action on the glass film caused by an excess of halogen compound. The most preferable range is 0.025–0.050 parts by weight.

FIG. 1 shows the results of glass film formation performance in the course of final annealing, using the solid solution metallic oxide compound of the present invention, with $MnCl_2$ as the halogen compound added to this solid solution metallic oxide compound, and conventional MgO, respectively. It is clear from these results that the present invention's compound shows that glass film is formed from at a lower temperature in the heating stage. Especially, a significant reaction is observed when $MnCl_2$ is added to this compound.

An alkali metal or alkaline earth metal compound is added along with the halogen compound, so that the amount of one or more elements within this halogen compound should be in the range of 0.01–0.50 part by weight relative to 100 parts by weight of the sold solution metallic oxide described halogen compound must be kept stable from the slurry control stage, including coating and drying steps, to the final annealing stage of glass film formation. Alkali metal or alkaline earth metal compounds ionize depending upon their solubility and combine with halogen ions dissolved in the slurry, and the new halogen compound with alkali metal or alkaline earth is then formed in the coating and drying steps. These uniformly cover the surface of the metallic oxide compound particle and oxide film on a steel sheet, and stabilize the glass formation. As a result, an enhanced glass film forming reaction can be obtained by the addition of the above halogen compound.

FIG. 2 shows the results of the appearance level of glass film formation using various annealing separator when the dew point the atmospheric gas is varied in the course of the heating stage. The solid solution metallic oxide compound of the present invention shows a wide range of stable glass film formation compared with the conventional MgO. It is also shown that an excellent quality of glass film is obtained over an extremely wide range of atmosphere conditions when a halogen compound is added. The amount of alkali metal or alkaline earth added is 0.01–0.05 parts by weight relative to 100 parts by weight of the metallic oxide compound. If this amount is less than 0.01 parts by weight, the effect of the halogen compound is not stable enough. On the other hand, if this amount is more than 0.05 parts by weight, the quality of the glass film deteriorates because of the generation of etching action in the high temperature stage of the final annealing stage. In case of addition of halogen, one or more metallic elements selected from Li, Ba, Ti, V, Ta, Cr, Mo, W, Mn, Fe, Co, Ni, Cu, Zn, Ag, Cd, Al or Sn is added at 0.005–0.120 weight part with calcinated F, Cl or Br as the total amount relative to 100 weight part of the metallic oxide compound. If the halogen compound is added during the production of the metallic oxide compound, it needs to control by anions or halogen compounds are added at final hydration stage. Thereafter, various calcination conditions are controlled, such as temperature, time, atmosphere, projection amount of low materials into furnace, penetration in a calcination furnace, the amount of F, Cl or Br is adjusted to become 0.005–0.120 weight part.

F, Cl or Br is added and mixed to give 0.005–0.120 weight part relative to 100 weight part of the metallic oxide compound at the slurry making stage when it is required to adjust the amount of halogen compound at the slurry making stage after MgO calcination. These halogen compounds easily dissolve and finely disperse in a slurry, and uniformly adhere to the surface of the solid solution metallic oxide compound or oxide film on a steel sheet. As a result, reaction of the $SiO_2$ layer with the metallic oxide compound is further increased by those halogen compounds during the heating stage in the final annealing. As described above, excellent glass film formation can be obtained in both cases in calcination and drying of slurry containing halogen compound, and control an amount of halogen compound at slurry making stage. The amount of halogen compound added should be 0.005–0.120 parts by weight in total. If this amount is less than 0.005 parts by weight, the effect of these compounds is not clear because of the excellent reactivity of the present invention's solid solution metallic oxide compound. These halogen compounds easily dissolve and finely disperse in a slurry, and uniformly adhere to a surface of metallic oxide compound or oxide film on a steel sheet. As a result, reaction of the $SiO_2$ layer with the metallic oxide compound is further increased by those halogen compounds during the heating stage in the final annealing. As described above, excellent glass film formation can be obtained in both cases in calcination and drying of slurry containing halogen compound, and control an amount of halogen compound at slurry making stage. The amount of addition these halogen compound is 0.005–0.120 weight part as total amount. If this amount is less than 0.005 weight part, the effect by these compound is not clear because of the present invented metallic oxide compound essentially having excellent reactivity. On the other hand, if this amount is more than 0.120 weight part, it generates a dissolve or destructive action, and leads to unevenness in glass film, reduced film thickness, deterioration of the sealing effect, reduced film tension and/or reduced adhesion. The most preferable range is 0.015–0.060 weight part as total amount of halogen. If one or more compounds selected from hydrochloric acid, chloric acid, perchloric acid, or oxychloride are used, a desirable effect of addition is easily obtainable because of uniform dissolution and easy dispersion in slurry. Under these circumstances, the amount of these compound added and dispersed is 0.005–0.120 parts by weight as Cl relative to 100 parts by weight of metallic oxide compound. The limitations to the amount added are for the same reasons as for the above halogen case.

The thus obtained metallic oxide compound is used in the actual production of grain-oriented silicon steel as follows.

The hot-rolled grain-oriented steel strip as a starting material containing proper inhibitors such as AlN and/or MnS is cold-rolled to a final thickness, and subsequently treated by decarburization annealing. Then, an oxide film mainly containing $SiO_2$ is formed on the surface of the thus treated strip, an annealing separator mainly containing MgO is coated, and the final annealing, treating with an insulation coating and heat-flattening are carried out. In those production steps, at least one element or compound selected from the solid solution metallic oxide compounds as an annealing separator according to the present invention as described above is coated on the surface of decarburized steel strip.

In those production steps, certain must be met to improve the film quality and magnetic properties. One important production step is the final annealing, which is controlled to a heating rate of less than 12° C./hr to a temperature range of between 800°–1100° C. at heating stage and subsequently maintaining the temperature at 1150°–1250° C. Under those conditions, a unique film improvement effect is obtained in addition to the reactability increasing effect of the above-mentioned annealing separator. More specifically, when the solid solution metallic oxide compound according to the present invention is applied to high permeability grain-oriented silicon steel materials having a characteristic of secondary recrystallization at high temperature, a remarkable effect is obtained. The reasons for adopting the slow heating rate at a temperature range of 800°–1100° C. is as follows. The first one is that little progress on glass film formation below 850° C.

The second one is that it brings infection on glass film formation, which it makes progress a reduction in oxide film before the start of glass film formation by slow heating rate at low temperature area. The method for heating rate between 800°–1100° C. carried out the slow heating less than 12° C./Hr constantly, or heating with isothermally kept at predetermined temperature. If the average heating rate is more than 12° C./Hr, a glass film is not formed and cause unstable results. Considering the actual operation conditions, more preferable heating times is for 5–15 hours and temperature ranges is at 800°–1050° C. There is no specific heating rate limitation before 800° C. and after 1100C. However, this heating rate is determined as 15°–30° C./Hr as the preferable range considering the soaking extent of the coils and productivity. Under this condition, a glass film is formed uniformly and dense, and effectively avoid troubles, such as the resoluted and exhausted water come out between coils at the low temperature area, the exhausted water in annealing atmosphere gas and additional oxidation by oxygen. As a result, a uniform film and excellent magnetic properties in entire length can be obtained.

In applying the solid solution metallic oxide compound according to the present invention, it is possible to use 1) one or more of these compounds individually, 2) one or more of these compounds with halogen, 3) one or more of these compounds properly mixed with regular MgO, 4) one or more of these compounds properly mixed with regular MgO and addition of halogen. Although the conventional MgO powder objects to arrange for control of slurry viscosity and for adjustment of hydrated water. There is no different results in the way of use.

The present invention will now be described in detail with reference to the following examples, that by no means limit the scope of the invention.

EXAMPLE 1

A grain-oriented silicon steel material containing 0.050% by weight of C, 3.15% by weight of Si, 0.063% by weight of Mn, 0.024% by weight of S, and 0.007% by weight of A1, with the balance comprising Fe and unavoidable impurities was processed by normal production steps, i.e., hot-rolling, one or two step cold-rolling with annealing to a final thickness of 0.34 mm. Thereafter, the thus obtained cold-rolled band is treated by decarburization annealing in a wet hydrogen-nitrogen mixed atmosphere (25% $N_2$ and 75% $H_2$) for decarburization and formation of an oxide film mainly containing $SiO_2$on the steel sheet surface.

Subsequently, an annealing separator of the present invention's solid solution metallic oxide compound as shown in Table 1 is coated at about 15 g/m$^2$ (7.5 g per each surface) on a steel sheet surface and dried, then wound in 20 tons coil and finally annealed at a temperature of 1200° C. for 20 hours.

Thereafter, an insulation coating containing 20% colloidal silica in amount of 100 ml combined with 50% aluminum phosphate in amount of 6 g is coated onto the thus annealed coil. Then heat-flattening and baking are carried out at a temperature of 850° C. The conditions of the glass film after the final annealing and film properties after baking the insulation coating in these tests are shown in Table 2.

TABLE 1

| Annealing separator | Chemical composition of the solid solution metallic oxide compound $Mg(M^{2+})_{1-x}$ | $M^{2+}_{x1}$ | $M^{3+}_{x2}$ |
|---|---|---|---|
| Present Invention 1 | 0.9 | $Ba_{0.1}$ | — |
| Present Invention 2 | 0.9 | $Ca_{0.1}$ | — |
| Present Invention 3 | 0.9 | $Sr_{0.1}$ | — |
| Present Invention 4 | 0.9 | $Mn_{0.1}$ | — |
| Present Invention 5 | 0.9 | $Fe_{0.1}$ | — |
| Present Invention 6 | 0.9 | $Ca_{0.05}$ | $Al_{0.05}$ |
| Comparative Example 1 | 1.0 (MgO only) | — | — |

TABLE 2

| Annealing separator | Conditions of glass film formation | Adhesion after insulation coating (20 mm ϕ bending) | Magnetic properties $B_8$(T) | $W_{17/50}$ (W/Kg) |
|---|---|---|---|---|
| Present Invention 1 | good, uniform in overall length and width | No peeling | 1.862 | 1.26 |
| Present Invention 2 | good, uniform in overall length and width | " | 1.852 | 1.24 |
| Present Invention 3 | good, uniform in overall length and width | " | 1.865 | 1.23 |
| Present Invention 4 | good, uniform in overall length and width | " | 1.863 | 1.23 |
| Present Invention 5 | good, uniform in overall length and width | " | 1.862 | 1.21 |
| Present Invention 6 | good, uniform in overall length and width | " | 1.865 | 1.22 |
| Comparative Example 1 | uneven and thin, gasmarks at edge portions | Peeling over about 60% of surface area | 1.833 | 1.31 |

It can be clearly seen that a thick and glossy glass film is uniformly formed over the whole surface and shows good adhesion after insulation coating in each of the examples, according to the present invention. On the other hand, the comparative example which uses the conventional MgO as an annealing separator generates unevenness like gas marks at the edge portions, and shows poor adhesion.

In addition, the product obtained using the present invention's compound shows stable magnetic properties, and excellent iron loss compared with the poor results of the comparative example.

EXAMPLE 2

A high permeability grain-oriented silicon steel material containing 0.075% by weight of C, 3.25% by weight of Si, 0.075% by weight of Mn, 0.025% by weight of S, 0.010% by weight of Cu, 0.08% by weight of Sn, 0,028% by weight of Al, and 0.008% by weight of N, with the balance comprising Fe and unavoidable impurities was processed by normal production steps, i.e., hot rolling, hot band annealing and cold-rolling to a final thickness of 0.25 mm. Then, the thus obtained cold-rolled band is treated by decarburization annealing in a wet hydrogen/nitrogen mixed atmosphere (25% $N_2$ and 75% $H_2$) having a dew point of about 65° C. for decarburization.

Subsequently, an annealing separator of the present invention's solid solution metallic oxide compound as shown in Table 3 is coated at about 12 g/m$^2$ (6 g per each surface) on a steel sheet surface and dried. Thereafter, final annealing is carried out at a temperature of 1200° C. for 20 hours, then an insulation coating is applied to the thus annealed strip of the same composition as in Example 1, in an amount of 5 g/m$^2$. Then heat-flattening and baking are carried out at a temperature of 850° C. The film properties and magnetic properties are shown in Table 4.

TABLE 3

| Annealing separator | Chemical composition of the solid solution metallic oxide compound $Mg(M^{2+})_{1-x}$ | $M^{2+}_{x1}$ | $M^{3+}_{x2}$ | Additives *1 (weight part) |
|---|---|---|---|---|
| Present Invention 1 | 0.80 | $Ba_{0.1}$ | $Co_{0.1}$ | $TiO_2$: 5/0 |
| Present Invention 2 | 0.80 | $Ca_{0.1}$ | $Ti_{0.1}$ | $Na_2B_4O_7$: 0.1 |
| Present Invention 3 | 0.80 | $Cu_{0.1}$ | $Sb_{0.1}$ | $Sb_2(SiO_4)_3$: 0.1 |
| Present Invention 4 | 0.75 | $Fe_{0.1}$ | $Al_{0.15}$ | |
| Present Invention 5 | 0.75 | $Mn_{0.1}$ $Co_{0.15}$ | — | |
| Present Invention 6 | 0.75 | — | $Fe_{0.2}$ | |
| Comparative Example 1 | 1.0 | — | — | |

*1: Additives: Added ratio per 100 weight part of the metallic oxide compound

TABLE 4

| Annealing separator | Conditions of glass film formation | Glass film tension (Kg/mm$^2$) | Adhesion after insulation coating (20 mm ϕ bending) | Magnetic properties $B_8$(T) | $W_{17/50}$ (W/Kg) |
|---|---|---|---|---|---|
| Present invention 1 | thick, uniform in overall area and glaze | 0.50 | No peeling | 1.940 | 0.83 |
| Present invention 2 | thick, uniform in overall area and glaze | 0.52 | " | 1.942 | 0.82 |
| Present invention 3 | thick, uniform in overall area and glaze | 0.60 | " | 1.953 | 0.80 |
| Present invention 4 | thick, uniform in overall area and glaze | 0.56 | " | 1.966 | 0.78 |
| Present invention 5 | thick, uniform in overall area and glaze | 0.48 | " | 1.940 | 0.84 |
| Present invention 6 | thick, uniform in overall area and glaze | 0.55 | " | 1.968 | 0.78 |
| Comparative | slight | 0.29 | slight | 1.936 | 0.88 |

TABLE 4-continued

| Annealing separator | Conditions of glass film formation | Glass film tension ($Kg/mm^2$) | Adhesion after insulation coating (20 mm ϕ bending) | Magnetic properties $B_8$(T) | $W_{17/50}$ (W/Kg) |
|---|---|---|---|---|---|
| Example 1 | gasmark at edge portion and thin | | peeling | | |

It Can be clearly seen that the glass film is uniformly formed and shows high tension and good adhesion properties in each example according to the present invention. In addition, the magnetic properties of the final products show high permeability and excellent iron loss. On the other hand, the glass film and magnetic properties using the conventional MgO as a comparative example are inferior compared with the present invention's annealing separator.

EXAMPLE 3

A grain-oriented silicon steel slab containing 0.060% by weight of C, 3.30% by weight of Si, 1.05% by weight of Mn, 0.008% by weight of S, 0.030% by weight of Al, 0.008% by weight of N and 0.03% by weight of Sn with the balance comprising Fe and unavoidable impurities was heated to a relatively low slab heating temperature of 1250° C. This heated slab was processed normal production steps, i.e., hot-rolling, hot band annealing, pickling and cold-rolling to a final thickness of 0.225 mm. Then, the thus obtained cold-rolled strip was treated by decarburization annealing in a wet hydrogen/nitrogen mixed atmosphere (25% $N_2$ and 75% $H_2$) having a dew point of about 65° C. for decarburization and formation of $SiO_2$ film simultaneously. Subsequently, nitrization treatment was carried out on the decarburized strip in a dry atmosphere (25% of $N_2$, 75% $H_2$ and $NH_3$) at a temperature of 750° C. for 30 seconds so that the total $N_2$ content of the strip reached 200 ppm, in an independent furnace in the same production line. Then, an annealing separator of the present invention's solid solution metallic oxide compound as shown in Table 5 was coated to about 12 $g/m^2$ (6 g per each surface) on the thus nitrized strip, and dried. Thereafter, final annealing and insulation coating were carried out as in Examples 1 and 2. The film properties and magnetic properties are shown in Table 6.

TABLE 5

| Annealing separator | Chemical composition of the solid solution metallic oxide compound $Mg(M^{2+})_{1-x}$ | $M^{2+}_{x1}$ | $M^{3+}_{x2}$ | Additives *1 (weight part) |
|---|---|---|---|---|
| Present invention 1 | 0.70 | Be: 0.10 | Al: 0.20 | $TiO_2$: 3.0 |
| Present invention 2 | 0.70 | Sr: 0.10 | Al: 0.20 | $Na_2B_4O_7$: 0.1 |
| Present invention 3 | 0.70 | — | Al: 0.15 + Fe: 0.15 | $MnCl_2$: 0.05 |
| Present invention 4 | 0.70 | Fe: 0.20 | Cr: 0.10 | |
| Present invention 5 | 0.75 | Co: 0.10 | Fe: 0.15 | |
| Comparative Example 1 | 0.50 | Sr: 0.25 | Al: 0.25 | |

TABLE 5-continued

| Annealing separator | Chemical composition of the solid solution metallic oxide compound $Mg(M^{2+})_{1-x}$ | $M^{2+}_{x1}$ | $M^{3+}_{x2}$ | Additives *1 (weight part) |
|---|---|---|---|---|
| Comparative Example 2 | 0.50 (MgO only) | — | — | |

TABLE 6

| Annealing separator | Conditions of glass film formation | Glass film tension ($Kg/mm^2$) | Adhesion after insulation coating (20 mm ϕ bending) | Magnetic properties $B_8$(T) | $W_{17/50}$ (W/Kg) |
|---|---|---|---|---|---|
| Present invention 1 | uniform in overall area and glaze | 0.60 | No peeling | 1.940 | 0.82 |
| Present invention 2 | uniform in overall area and glaze | 0.65 | " | 0.948 | 0.80 |
| Present invention 3 | uniform in overall area and glaze | 0.67 | " | 1.960 | 0.70 |
| Present invention 4 | uniform in overall area and glaze | 0.70 | " | 1.955 | 0.73 |
| Present invention 5 | uniform in overall area and glaze | 0.69 | " | 1.962 | 0.68 |
| Comparative Example 1 | peroxidation defects | 0.55 | slight peeling | 1.948 | 0.84 |
| Comparative Example 2 | peroxidation defects | 0.30 | peeling | 1.915 | 0.88 |

It is clearly seen in the above Tables 5 and 6 that glass film is uniformly formed and shows high tension and good adhesion properties according to the present invention's compounds. In addition, the magnetic properties of the final products are excellent. On the other hand, there are relatively many glass film defects, and the appearance is bare spot and gasmark caused by peroxidation condition in Comparative Example 1, which contains an excess amount of the $M^{2+}$ and $M^{3+}$ compound. Furthermore, there are other glass film defects, lack of uniformity, thin film thickness, low film tension and poor magnetic properties in Comparative Example 2, compared with Examples 1–5 of the present invention.

EXAMPLE 4

A high permeability grain-oriented silicon steel slab containing 0.077% by weight of C, 3.23% by weight of Si, 1.075% by weight of Mn, 0.025% by weight of S, 0.08% by weight of Cu, 0.08% by weight of Sn, 0.028% by weight of Al, 0.007% by weight of N and with the balance comprising Fe and unavoidable impurities was processed by normal production steps, i.e., hot-rolling, hot band annealing, pickling and cold-rolling to a final thickness of 0.225 mm. Then, the thus obtained cold-rolled strip was treated by decarburization annealing in a wet hydrogen/nitrogen mixed atmosphere (25% $N_2$ and 75% $H_2$) having a dew point of about 66° C. Then, an annealing separator of present invention's solid solution metallic oxide compound as shown in Table 5 was coated to about 12 g/m$^2$ (6 g per each surface) on the thus nitrized strip, and dried. Thereafter, final annealing and insulation coating were carried out as in Examples 1 and 2. The film properties and magnetic properties are shown in Table 6.

It can be clearly seen in the above Tables 7 and 8 that a glass film is uniformly formed over the whole area of the sheet and shows high tension and good adhesion properties using the present invention's compounds as an annealing separator. In addition, the magnetic properties such as permeability and iron loss of the final products are excellent. On the other, hand, Comparative Example 1, which uses the conventional MgO, shows poor film properties and magnetic properties.

TABLE 7

| Annealing separator | Chemical composition of the solid solution metallic oxide compound | | | | | | Specific surface area |
|---|---|---|---|---|---|---|---|
| | $Mg(M^{2+})_{1-x}$ | $Fe^{3+}$ | $Fe^{2+}$ | $M^{2-}{}_{x1}$ | $M^{3+}{}_{x2}$ | Ay | (m$^2$/g) |
| Present Invention 1 | 0.70 | 0.15 | — | $Ba_{0.15}$ | — | $Cl_{0.005}$ | 45 |
| Present Invention 2 | 0.70 | 0.15 | — | $Ca_{0.10}$ | $Ti_{0.05}$ | $Cl_{0.005}$ | 30 |
| Present Invention 3 | 0.70 | 0.15 | — | $Co_{0.10}$ | — | $Cl_{0.005}$ | 85 |
| Present Invention 4 | 0.70 | 0.15 | — | — | $Al_{0.15}$ | $PO_{3\ 0.010}$ | 70 |
| Present Invention 5 | 0.70 | — | 0.15 | $Mn_{0.1}$ + $Co_{0.05}$ | — | $PO_{3\ 0.010}$ | 70 |
| Present Invention 6 | 0.70 | — | 0.25 | — | $Sb_{0.05}$ | $SiO_{3\ 1.000}$ | 80 |
| Comparative Example 1 | 1.00 (MgO only) | — | — | — | — | — | 14 |

TABLE 8

| Annealing separator | Conditions of glass film formation | Glass film tension (Kg/mm$^2$) | Adhesion after insulation coating (20 mm ϕ bending) | Magnetic properties $B_8$(T) | $W_{17/50}$ (W/Kg) |
|---|---|---|---|---|---|
| Present Invention 1 | uniform in overall area and glaze | 0.58 | No peeling | 1.955 | 0.81 |
| Present Invention 2 | uniform in overall area and glaze | 0.58 | " | 1.951 | 0.82 |
| Present Invention 3 | uniform in overall area and glaze | 0.63 | " | 1.954 | 0.79 |
| Present Invention 4 | uniform in overall area and glaze | 0.55 | " | 1.966 | 0.77 |
| Present Invention 5 | uniform in overall area and glaze | 0.52 | " | 1.943 | 0.83 |
| Present Invention 6 | uniform in overall area and glaze | 0.58 | " | 1.953 | 0.80 |
| Comparative Example 1 | gasmarks at edge portion, thin | 0.30 | slight peeling | 1.925 | 0.87 |

EXAMPLE 5

A grain-oriented silicon steel slab containing 0.055% by weight of C, 3.29% by weight of Si, 1.00% by weight of Mn, 0.0078% by weight of S, 0.033% by weight of Al, 0.008% by weight of N and 0.03% by weight of Sn with the balance comprising Fe and unavoidable impurities was heated at a relatively low slab heating temperature of 1250° C. This heated slab was processed normal production steps, i.e., hot-rolling, hot band annealing, pickling and cold-rolling to a final thickness of 0.225 mm. Then, the thus obtained cold-rolled strip was treated by decarburization annealing in a wet hydrogen/nitrogen mixed atmosphere (25% $N_2$ and 75% $H_2$) having a dew point of at 65° C. for decarburization and formation of $SiO_2$ film simultaneously. Subsequently, nitrization treatment is carried out on the decarburized strip in a dry atmosphere (25% $N_2$, 75% $H_2$ and $NH_3$) at a temperature of 750° C. for 30 seconds so that the total $N_2$ content of the strip reached 200 ppm, in an independent furnace in the same production line. Then, an annealing separator of the present invention's solid solution metallic oxide compound as shown in Table 9 was coated to about 12 g/m$^2$ (6 g per each surface) on the thus nitrized strip, and dried. Thereafter, final annealing and insulation coating were carried out as in Example 1. The film properties and magnetic properties are shown in Table 10.

TABLE 9

| Annealing separator | Chemical composition of the solid solution metallic oxide compound | | | | | | Specific surface area |
|---|---|---|---|---|---|---|---|
| | $Mg(M^{2+})_{1-x}$ | $Fe^{3+}$ | $Fe^{2+}$ | $M^{2-}{}_{x1}$ | $M^{3+}{}_{x2}$ | Ay | ($m^2/g$) |
| Present Invention 1 | 0.65 | 0.20 | — | $Sr_{0.05}$ | $Al_{0.10}$ | $F_{0.03}$ | 70 |
| Present Invention 2 | 0.65 | — | 0.20 | $Sr_{0.05}$ | $Al_{0.10}$ | $F_{0.03}$ | 180 |
| Present Invention 3 | 0.65 | 0.20 | — | $Cu_{0.05}$ | $Sb_{0.10}$ | $BO_{3\ 0.10}$ | 150 |
| Present Invention 4 | 0.75 | 0.10 | — | $Cu_{0.15}$ | — | $PO_{3\ 0.30}$ | 60 |
| Present Invention 5 | 0.75 | — | 0.10 | — | $Cr_{0.15}$ | $SiO_{3\ 1.00}$ | 95 |
| Comparative Example 1 | 0.50 | — | 0.30 | — | $Al_{0.20}$ | $F_{0.03}$ | 30 |
| Comparative Example 2 | 1.00 (MgO only) | — | — | — | — | — | 12 |

TABLE 10

| Annealing separator | Conditions of glass film formation | Glass film tension ($Kg/mm^2$) | Adhesion after insulation coating (20 mm ϕ bending) | Magnetic properties $B_8$(T) | $W_{17/50}$ (W/Kg) |
|---|---|---|---|---|---|
| Present Invention 1 | uniform in overall area and glaze | 0.75 | No peeling | 1.948 | 0.79 |
| Present Invention 2 | uniform in overall area and glaze | 0.70 | " | 1.952 | 0.72 |
| Present Invention 3 | uniform in overall area and glaze | 0.67 | " | 1.955 | 0.68 |
| Present Invention 4 | uniform in overall area and glaze | 0.78 | " | 1.955 | 0.74 |
| Present Invention 5 | uniform in overall area and glaze | 0.69 | " | 1.949 | 0.77 |
| Comparative Example 1 | peroxide defects like bare spot gasmark | 0.50 | slight peeling | 1.940 | 0.82 |
| Comparative Example 2 | slightly thin film and white appearance | 0.30 | peeling | 1.913 | 0.89 |

It can be clearly seen in the above Tables 9 and 10 that a glass film is uniformly formed and shows high tension and good adhesion properties according to the present invention's compounds. In addition, the magnetic properties of the final products are excellent. On the other hand, there are relatively uneven glass film defects which its appearance has bare and gasmark caused by peroxidation condition in Comparative Example 1 which contains an excess amount of the $Fe^{2+}$ and $M^{2+}$ compound. Furthermore, there are many glass film defects, lack of uniformity, thin film the thickness, low film tension and poor magnetic properties in Comparative Example 2, compared with Examples 1–5 the present invention.

EXAMPLE 6

A high permeability grain-oriented silicon steel slab containing 0.08% by weight of C, 3.25% by weight of Si, 0.068% by weight of Mn, 0.024% by weight of S, 0.027% by weight of Al, 0.06% by weight of Cu, 0.08% by weight of Sn, 0.0078% by weight of N and with the balance comprising Fe and unavoidable impurities was processed by normal production steps, that is; hot-rolling, hot band annealing, pickling and cold-rolling to final thickness having 0.225 mm. Then, thus obtained cold-rolled strip is treated by decarburization annealing in a wet hydrogen/nitrogen mixed atmosphere (as 25% of $N_2$ and 75% of $H_2$) having a dew point about 67° C. at 850° C. for 110 seconds. Then, annealing separator was coated thereon, including various chlorine compounds, 5 parts by weight of $TiO_2$ and 0.3 parts by weight of $Na_2B_4O_7$ as the additives, relative to 100 weight parts (specific surface area is 70 $m^2/g$) of the present invention's combined metallic compound same as the "present invention 4 of the Example 2", as shown in Table 11, and dried. Thereafter, final annealing was carried out at a temperature of 1200° C. for 20 hours. Subsequently, insulation coating containing 30% of colloidal silica in an amount of 70 ml combined with 50% of aluminum phosphate in an amount of 50 ml and chlomic acid in an amount of 6 g is coated onto the annealed coil and baked as mentioned in the Example 1. The film and magnetic properties are shown in Table 12.

TABLE 11

| Annealing separator | | Added Chloride | | |
|---|---|---|---|---|
| No. | Main composition | Sort | Amount of Cl in Annealing separator | Other additives (weight part) |
| Present invention 1 | $(Mg_{0.75}Fe_{0.1}Al_{0.15})O$ | $MnCl_2$ | 0.020 | $TiO_2$: 5.0 |
| Present | $(Mg_{0.75}Fe_{0.1}Al_{0.15})O$ | $MnCl_2$ | 0.040 | $Na_2B_4O_7$: 0.3 |

TABLE 11-continued

| Annealing separator | | Added Chloride | | |
|---|---|---|---|---|
| No. | Main composition | Sort | Amount of Cl in Annealing separator | Other additives (weight part) |
| invention 2 | | | | |
| Present invention 3 | $(Mg_{0.75}Fe_{0.1}Al_{0.15})O$ | $MnCl_2$ | 0.060 | |
| Present invention 4 | $(Mg_{0.75}Fe_{0.1}Al_{0.15})O$ | $CoCl_2$ | 0.040 | |
| Present invention 5 | $(Mg_{0.75}Fe_{0.1}Al_{0.15})O$ | $NiCl_2$ | 0.040 | |
| Present invention 6 | $(Mg_{0.75}Fe_{0.1}Al_{0.15})O$ | $BaCl_2$ | 0.040 | |
| Present invention 7 | $(Mg_{0.75}Fe_{0.1}Al_{0.15})O$ | $FeCl_2$ | 0.040 | |
| Present invention 8 | $(Mg_{0.75}Fe_{0.1}Al_{0.15})O$ | $MnCl_2$ | 0.040 | |
| Comparative Example 1 | MgO | — | 0.150 | |
| Comparative Example 2 | MgO | $MnCl_2$ | 0.0050 | |
| Comparative Example 3 | MgO | $MnCl_2$ | 0.040 | |

TABLE 12

| Annealing separator | Conditions of glass film formation | Glass film tension ($Kg/mm^2$) | Adhesion after insulative coating (20 mm ϕ bending | Magnetic properties $B_s$(T) | $W_{17/50}$ (W/Kg) |
|---|---|---|---|---|---|
| Present Invention 1 | Extremely uniform in overall area and glaze, thick | 0.37 | No peeling | 1.932 | 0.85 |
| Present Invention 2 | Extremely uniform in overall area and glaze, thick | 0.46 | " | 1.944 | 0.83 |
| Present Invention 3 | Extremely uniform in overall area and glaze, thick | 0.53 | " | 1.946 | 0.81 |
| Present Invention 4 | Extremely uniform in overall area and glaze, thick | 0.50 | " | 1.943 | 0.82 |
| Present Invention 5 | Extremely uniform in overall area and glaze, thick | 0.52 | " | 1.945 | 0.81 |
| Present Invention 6 | Extremely uniform in overall area and glaze, thick | 0.55 | " | 1.945 | 0.80 |
| Present Invention 7 | Extremely uniform in overall area and glaze, thick | 0.49 | " | 1.951 | 0.81 |
| Present Invention 8 | Extremely uniform in overall area and glaze, thick | 0.58 | " | 1.948 | 0.87 |
| Comparative Example 1 | relatively pin-hole defects, unevenness | 0.38 | Partly slight peeling | 1.923 | 0.85 |
| Comparative Example 2 | extremely thinning film to base metal | 0.12 | Peeling in overall area | 1.897 | 0.92 |
| Comparative Example 3 | uneven, dim, white appearance | 0.20 | Peeling | 1.910 | 0.86 |

According to these experiments, it can be seen that a uniform and dense glass film having high tension and good adhesion can be obtained by using the present invention's compound. It also can be obtained an excellent magnetic properties. On the other hand, annealing separator as shown by the Comparative examples mainly containing conventional MgO shows extremely poor results in appearance of glass film such as uneven film, pinhole caused by excess amount of chloride and by peroxidation. Simultaneously, inferior magnetic properties obtained in the Comparative examples. Furthermore, in the case of the conventional MgO shown in the Comparative examples, magnetic properties was not so improved by addition of chloride, and showed very poor results without addition of chloride.

EXAMPLE 7

A high permeability grain-oriented silicon steel slab containing 0.078% by weight of C, 3.35% by weight of Si,
0.060% by weight of Mn, 0.024% by weight of S,
0.025% by weight of Al, 0.06% by weight of Cu,
0,012% by weight of Sn, 0.008% by weight of N and with the balance comprising Fe and unavoidable impurities was processed by normal production steps,i.e., hot-rolling, hot band annealing, pickling and cold-rolling to a final thickness of 0.225 mm. Then, the thus obtained cold-rolled strip was treated by decarburization annealing in a wet hydrogen/nitrogen mixed atmosphere (25% $N_2$ and 75% $H_2$) having a dew point of at 67° C. Then, an annealing separator was coated thereon including chloride combined with alkali metal compounds in the necessary amounts as shown in Table 13, relative to 100 weight part of the present invention's solid solution metallic oxide compound using the "Present invention 5" in Example 1 in an amount of 70 $m^2/g$ as a specific surface area and 3.0% of hydrated water volume, and dried. Thereafter, final annealing and insulation coating are carried out in the same way as mentioned in Example 1. The film and magnetic properties are shown in Table 14.

TABLE 13

| Annealing separator | | | | Added alkali metal and alkaline | |
|---|---|---|---|---|---|
| | Main | Added Chloride | | earth metal, | |
| No. | composition | Compound | Volume | and its volume | |
| Present invention 1 | $(Mg_{0.9}Fe_{0.1})O$ | LiCl | 0.04 | KOH | 0.3 |
| Present invention 2 | $(Mg_{0.9}Fe_{0.1})O$ | $AlCl_3$ | 0.04 | KOH | 0.3 |
| Present invention 3 | $(Mg_{0.9}Fe_{0.1}O$ | $CuCl_2$ | 0.04 | KOH | 0.3 |
| Present invention 4 | $(Mg_{0.9}Fe_{0.1}O$ | $FeCl_2$ | 0.04 | KOH | 0.3 |
| Present invention 5 | $(Mg_{0.9}Fe_{0.1}O$ | $ZnCl_2$ | 0.04 | $CaB_4O_7$ | 0.5 |
| Present invention 6 | $(Mg_{0.9}Fe_{0.1}O$ | $CdCl_2$ | 0.04 | $CaB_4O_7$ | 0.5 |
| Present invention 7 | $(Mg_{0.9}Fe_{0.1}O$ | $Mg(OH)_5Cl$ | 0.04 | $CaB_4O_7$ | 0.5 |
| Present invention 8 | $(Mg_{0.9}Fe_{0.1}O$ | HCl | 0.04 | $CaB_4O_7$ | 0.5 |
| Present invention 9 | $(Mg_{0.9}Fe_{0.1}O$ | LiCl | 0.04 | — | — |
| Comparative Example 1 | MgO[x1] | — | — | — | — |
| Comparative Example 2 | MgO[x1] | LiCl | 0.04 | KOH | 0.3 |

[x1]; 70 $m^2/g$ of specific surface area and 3.0% of hydrated water volume

TABLE 14

| Annealing separator | Conditions of glass film formation | Glass film tension ($Kg/mm^2$) | Adhesion after insulation coating (20 mm ϕ bending | Magnetic properties $B_s(T)$ | $W_{17/50}$ (W/Kg) |
|---|---|---|---|---|---|
| Present invention 1 | Extremely uniform in overall area and glaze, thick | 0.49 | No peeling off | 1.942 | 0.82 |
| Present invention 2 | Extremely uniform in overall area and glaze, thick | 0.53 | No peeling off | 1.946 | 0.81 |
| Present invention 3 | Extremely uniform in overall area and glaze, thick | 0.55 | No peeling off | 1.939 | 0.83 |
| Present invention 4 | Extremely uniform in overall area and glaze, thick | 0.58 | No peeling off | 1.942 | 0.82 |
| Present invention 5 | Extremely uniform in overall area and glaze, thick | 0.49 | No peeling off | 1.948 | 0.83 |
| Present invention 6 | Extremely uniform in overall area and glaze, thick | 0.54 | No peeling off | 1.952 | 0.79 |
| Present invention 7 | Extremely uniform in overall area and glaze, thick | 0.50 | No peeling off | 1.940 | 0.82 |

TABLE 14-continued

| Annealing separator | Conditions of glass film formation | Glass film tension ($Kg/mm^2$) | Adhesion after insulation coating (20 mm ϕ bending | Magnetic properties $B_s(T)$ | $W_{17/50}$ (W/Kg) |
|---|---|---|---|---|---|
| Present invention 8 | Extremely uniform in overall area and glaze, thick | 0.49 | No peeling off | 1.938 | 0.81 |
| Present invention 9 | uniform and thick | 0.46 | slight peeling | 1.935 | 0.84 |
| Comparative Example 1 | relatively pin-hole defects, unevenness | 0.14 | peeling off over whole area | 1.902 | 0.91 |
| Comparative Example 2 | extremely thin film | 0.29 | relatively peeling | 1.912 | 0.87 |

According to these experiments, glazing glass film is uniformly formed over the whole sheet using the present invention's compounds as annealing separators as shown in Tables 13 and 14. Especially, addition in combination with alkali metal and alkaline earth metal compounds and chlorides as additives provides excellent results. The chloride of "Present invention 9" shows good results, but slight deteriorated uniformity of glass film formation and magnetic properties compared with the other examples of the above combined addition according to the present invention. On the other hand, an annealing separator mainly containing conventional MgO in the Comparative Example shows extremely poor results in appearance of glass film and magnetic properties, compared with the present invention.

EXAMPLE 8

A grain-oriented silicon steel slab containing 0.055% by weight of C, 3.30% by weight of Si, 1.30% by weight of Mn, 0.0080% by weight of S, 0.028% by weight of Al, 0.0072% by weight of N and 0.04% by weight of Sn with the balance comprising Fe and unavoidable impurities was heated at a relatively low slab heating temperature of 1150° C., and hot rolled to a thickness of 2.3 mm. This hot rolled steel strip was annealed at a temperature of 1120° C. with pickling, and then cold rolled to obtain a final thickness of 0.225 mm. The thus obtained cold-rolled strip was decarburization annealed at a temperature of 830° C. for 110 seconds in a wet hydrogen/nitrogen mixed atmosphere (25% $N_2$ and 75% $H_2$) having a dew point of about 67° C., and nitrization annealed at a temperature of 830° C. for 30 seconds in a dry atmosphere (25% $N_2$, 75% $H_2$ and $NH_3$) so that the total $N_2$ content of the strip reached 200 ppm, in a continuous line.

Then, the annealing separator of the "present invention 6" of the present invention's combined metallic compound, with 100 weight part of conventional MgO, and halogen compound addition to 5 parts by weight of MgO as comparative examples were coated on the thus nitrized strip as shown in Table 15. Thereafter, final annealing and insulation coating are carried out in the same way as in Example 1. The film and magnetic properties are shown in Table 16.

TABLE 15

| Annealing separator | Basic oxides | Added halogen compound | Weight % of halogen element relative to solid solution metallic oxide compound and MgO | Annealing cycle |
|---|---|---|---|---|
| Present invention 1 | $(Mg_{0.9}Ca_{0.05}Al_{0.05})O$ | $CoCl_2$ | 0.02 | (A) |
| Present invention 2 | $(Mg_{0.9}Ca_{0.05}Al_{0.05})O$ | $CoCl_2$ | 0.04 | cycle of |
| Present invention 3 | $(Mg_{0.9}Ca_{0.05}Al_{0.05})O$ | $Cocl_2$ | 0.06 | FIG. 3 |
| Present invention 4 | $(Mg_{0.9}Ca_{0.05}Al_{0.05})O$ | $SnF_2$ | 0.02/0.02 | |
| Present invention 5 | $(Mg_{0.9}Ca_{0.05}Al_{0.05})O$ | $NiCl_2$ + AgBr | 0.02/0.02 | |
| Comparative Example 1 | $(Mg_{0.9}Ca_{0.05}Al_{0.05})O$ | $CoCl_2$ | 0.15 | |
| Comparative Example 2 | Conventional MgO | — | — | |
| Present invention 6 | $(Mg_{0.9}Ca_{0.05}Al_{0.05})O$ | $CoCl_2$ | 0.04 | (B) |
| Present invention 7 | $(Mg_{0.9}Ca_{0.05}Al_{0.05})O$ | $SnF_2$ | 0.04 | cycle of |
| Present invention 8 | $(Mg_{0.9}Ca_{0.05}Al_{0.05})O$ | $NiCl_2$ + AgBr | 0.02/0.02 | FIG. 3 |
| Comparative Example 3 | Conventional MgO | — | — | |
| Present invention 9 | $(Mg_{0.9}Ca_{0.05}Al_{0.05})O$ | $CoCl_2$ | 0.04 | (C) |
| Present invention 10 | $(Mg_{0.9}Ca_{0.05}Al_{0.05})O$ | $SnF_2$ | 0.04 | cycle of |
| Present invention 11 | $(Mg_{0.9}Ca_{0.05}Al_{0.05})O$ | $NiCl_2$ + AgBr | 0.02/0.02 | FIG. 3 |
| Comparative Example 4 | Conventional MgO | — | — | |

TABLE 16

| Annealing separator | Performance of glass film: Conditions of glass film formation | Glass film tension ($Kg/mm^2$) | Adhesion after insulation coating (20 mm ϕ bending) | Magnetic properties: $B_s$(T) | $W_{17/50}$ (W/Kg) |
|---|---|---|---|---|---|
| Present Invention 1 | Minute and uniform in overall area and glaze | 0.57 | No peeling | 1.945 | 0.84 |
| Present Invention 2 | Very minute and uniform in overall area and glaze | 0.65 | No peeling | 1.943 | 0.79 |
| Present Invention 3 | Very minute and uniform in overall area and glaze | 0.69 | No peeling | 1.945 | 0.74 |
| Present Invention 4 | Very minute and uniform in overall area and glaze | 0.64 | No peeling | 1.943 | 0.81 |
| Present Invention 5 | Very minute and uniform in overall area and glaze | 0.68 | No peeling | 1.937 | 0.80 |
| Comparative Example 1 | Gasmark and spot with metallic glaze | 0.48 | Slight peeling | 1.915 | 0.86 |
| Comparative Example 2 | Thin and uneven, gasmark | 0.38 | Fairly peeling | 1.905 | 0.88 |
| Present Invention 6 | Minute and uniform in overall area and glaze | 0.70 | No peeling | 1.945 | 0.76 |
| Present Invention 7 | Very minute and uniform in overall area and glaze | 0.75 | No peeling | 1.955 | 0.73 |
| Present Invention 8 | Very minute and uniform in overall area and glaze | 0.76 | No peeling | 1.952 | 0.75 |
| Comparative Example 3 | Thin and uneven, gasmark | 0.41 | Fairly peeling | 1.910 | 0.86 |
| Present Invention 9 | Thick and uneven, gasmark | 0.50 | Slight peeling | 1.927 | 0.84 |
| Present Invention 10 | Thick and uneven, gasmark | 0.52 | Slight peeling | 1.920 | 0.85 |
| Present Invention 11 | Thick and uneven, gasmark | 0.55 | Slight peeling | 1.926 | 0.83 |
| Comparative Example 4 | Very thin in overall area and thinning base metal | 0.30 | Total peeling | 1.890 | 0.91 |

From the above experiments, it can be seen that a uniform, dense and thick glass film having high tension and good adhesion can be obtained by using the present invention's solid solution metallic oxide compound adding a halogen compound as an annealing separator and by using a final annealing cycle having a slow heating as shown in FIG. 3(A) or (B). Excellent magnetic properties are also obtained. On the other hand, both glass film and magnetic properties do not deteriorate so much in case of the final annealing cycle shown FIG. 3(C) without a slow heating rate, using the present invention's annealing separator. However poor results are obtained when using conventional MgO as an annealing separator and using various heating cycles as shown in FIG. 3(A), (B) and (C).

As apparent from the foregoing description, according to the present invention, solid solution metallic oxide compound which replaced ant dissolved to a part of MgO by other bivalent or tervalent metals as an annealing separator having a lower melting point and effect of accelerated reactivity produce uniform glass film having a high tension. Excellent magnetic properties can be obtained due to the sealing effect on the steel surface, which avoids a change of inhibitor's characteristics or weakening of inhibitor's strength, and leads to smooth secondary recrystallization. In addition, halogen compounds, alkali metals or alkaline earth metals are very effective additives, and the above-mentioned effects are further improved by their addition.

We claim:

1. Annealing separator having excellent reactivity for grain-oriented silicon steel sheet, which consists essentially of at least one solid solution metallic oxide compound selected from the following general formulas;

$$(Mg_{1-x}M^{3+}{}_{x})O,\ (Mg_{1-x}M^{2+}{}_{x})O \text{ or } (Mg_{1-x}M^{2+}{}_{x1}M^{3+}{}_{x2})O,$$

where $M^{2+}$is one or more bivalent metals selected from the group consisting of Be, Ca, Ba, Sr, Sr, Mn, Pe, Co, Ni, Cu or Zn;

$M^{3+}$is one or more tervalent metals selected from the group consisting of Al, Fe, Cr, Co, B, Ti or Sb;

$$0.01 \leqq x \leqq 0.40;$$

and $$x = x1 + x2.$$

2. Annealing separator having excellent reactivity for grain-oriented silicon steel sheet, which consists essentially of at least one solid solution metallic oxide compound selected from the following general formulas:

$$(Mg_{1-x}M^{3+}{}_{x}).Ay,\ (Mg_{1-x}M^{2+}{}_{x})O.Ay \text{ or } (Mg_{1-x}M^{2+}{}_{x1}M^{3+}{}_{x2}).Ay$$

where $M^{2+}$ is one or more bivalent metals selected from the group consisting of Be, Ca, Ba, Sr, Sn, Mn, Fe, Co, Ni, Cu or Zn;

$M^{3+}$is one or more tervalent metals selected from the group consisting of Al, Fe, Cr, Co, B, Ti or Sb;

$$0.01 \leqq x \leqq 0.40;$$

$$x = x1 + x2;$$

A is at least one of the following: F, Cl, Br, $Co_3$, $SiO_3$, $PO_3$ or $CrO_3$ $0.001 \leqq y \leqq 2.0$ (y is weight percentage with respect to 100 parts by weight of solid solution metallic oxide compound).

3. Annealing separator having excellent reactivity for grain-oriented silicon steel sheet, which consists essentially of at least one solid solution metallic oxide compound selected from the following general formula:

$$(Mg_{1-x}X^{a}{}_{x1}X^{b}{}_{x2})O.Ay$$

where $X^{a}$ consists of $Fe^{2+}$ and/or $Fe^{3+}$;

$X^{b}$ consists of $M^{2+}$ and/or $M^{3+}$;

$M^{2+}$ is one or more bivalent metal selected from the group consisting of Be, Ca, Ba, Sr, Sn, Mn, Fe, Co, Ni, Cu or Zn;

$M^{3+}$ is one or more tervalent metal selected from the group consisting of Al, Fe, Cr, Co, B, Ti or Sb;

$$0.01 \leqq x \leqq 0.40;$$

$$x = x1 + x2;$$

A is at least one of the following: F, Cl, Br, $Co_3$, $SiO_3$, $PO_3$ or $CrO_3$;

$0.001 \leqq y \leqq 2.0$ (y is weight percentage with respect to 100 parts by weight of solid solution metallic oxide compound).

4. Annealing separator according to claim 1, wherein a specific surface area of said solid solution metallic oxide compound is 15–200$m^2$/g, and its Citric Acid Activity value is 30–500 seconds at 30° C.

5. Method of applying an annealing separator in a production of grain-oriented silicon steel sheet which comprises cold rolling to obtain a final thickness, decarburization annealing, forming an oxide film mainly containing $SiO_2$, coating an annealing separator, final annealing, forming an insulation coating and heat-flattening treatment, the improvement wherein said annealing separator consisting essentially of at least one solid solution metallic oxide compound selected from the following general formulas;

$$(Mg_{1-x}M^{3+}{}_{x})O,\ (Mg_{1-x}M^{2+}{}_{x})O \text{ or } (Mg_{1-x}M^{2+}{}_{x1}M^{3+}{}_{x2})O,$$

where $M^{2+}$ is one or more bivalent metal selected from the group consisting of Be, Ca, Ba, Sr, Sn, Mn, Fe, Co, Ni, Cu or Zn;

$M^{3+}$is one or more tervalent metal selected from the group consisting of Al, Fe, Cr, Co, B, Ti or Sb;

$$0.01 \leqq x \leqq 0.40;$$

$$x = x1 + x2.$$

6. Method of applying an annealing separator in a production of grain-oriented silicon steel sheet which comprises cold rolling to obtain a final thickness, decarburization annealing, forming an oxide film mainly containing $SiO_2$, coating an annealing separator, final annealing, forming an insulation coating and heat-flattening treatment, the improvement wherein said annealing separator consisting essentially of at least one solid solution metallic oxide compound selected from the following general formulas;

$$(Mg_{1-x}M^{3+}{}_{x})O.Ay,\ (Mg_{1-x}M^{2+}{}_{x})O.Ay \text{ or } (Mg_{1-x}M^{2+}{}_{x1}M^{3+}{}_{x2})O.Ay$$

where $M^{2+}$ is one or more bivalent metal selected from the group consisting of Be, Ca, Ba, Sr, Sn, Mn, Fe, Co, Ni, Cu or Zn;

$M^{3+}$ is one or more tervalent metal selected from the group consisting of Al, Fe, Cr, Co, B, Ti or Sb;

$$0.01 \leqq x23\ 0.40;$$

$$x = x1 + x2;$$

A is at least one of the following; F, Cl, Br, $CO_3$, $SiO_3$, $PO_3$ or $CrO_3$ $0.001 \leqq y \leqq 2.0$ (y is weight percent with respect to 100 parts by weight of solid solution metallic oxide compound).

7. Method of applying an annealing separator in a production of grain-oriented silicon steel sheet which comprises cold rolling to obtain a final thickness, decarburization annealing, forming an oxide film mainly containing $SiO_2$, coating an annealing separator, final annealing, forming an insulation coating and heat-flattening treatment, the improvement wherein said annealing separator consisting essentially of at least one solid solution metallic oxide compound selected from the following general formula;

$$(Mg_{1-x}X^a_{x1}X^b_{x2})O.Ay$$

where $X^a$ consists of $Fe^{2+}$ and/or $Fe^{3+}$;

$X^b$ consists of $M^{2+}$ and/or $M^{3+}$;

$M^{2+}$ is one or more bivalent metal selected from the group consisting of Be, Ca, Ba, Sr, Sr, Mn, Fe, Co, Ni, Cu or Zn;

$M^{3+}$ is one or more tervalent metal selected from the group consisting of Al, Fe, Cr, Co, B, Ti or Sb;

$$0.01 \leqq x \leqq 0.40;$$

$$x = x1 + x2;$$

A is at least one of the following; F, Cl, Br, $Co_3$, $SiO_3$, $PO_3$ or $CrO_3$;

$0.001 \leqq y \leqq 2.0$ (y is weight percent with respect to 100 parts by weight of solid solution metallic oxide compound).

8. A process according to claim 5 wherein the annealing separator contains one or more compounds selected from the group consisting of sulfates, sulfides, borates, chlorides, or oxides in an amount of 0.05–10 parts by weight with respect to 100 parts by weight of the solid solution metallic oxide compound.

9. A process according to claim 5 wherein the annealing separator contains one or more compounds selected from the group consisting of halogen compounds of Cl, F or Br in an amount of 0.005–0.120 parts by weight with respect to 100 parts by weight of the solid solution metallic oxide compound.

10. A process according to claim 9, wherein addition of the halogen compound is carried out in the course of production of said solid solution metallic oxide compound or in the preparation of slurry of an annealing separator.

11. A process according to claim 5 wherein the annealing separator contains one or more compounds selected from the group consisting of 0.005–0.120 parts by weight of halogen compounds of Cl, F or Br and 0.01–0.50 parts by weight of alkali and/or alkaline metal with respect to 100 parts by weight of the solid solution metallic oxide compound.

12. A process according to claim 7, wherein a halogen compound is added in the course of production of said solid solution metallic oxide compound or in the preparation of a slurry of the annealing separator.

13. A process according to claim 12, wherein said halogen compound contains one or more elements selected from the group consisting of Li, Br, Ti, V, Ta, Cr, Mo, W, Mn, Fe, Co, Ni, Cu, Zn, Ag, Cd, Al or Sn.

14. A process according to claim 12, wherein said halogen compound contains one or more compounds selected from the group consisting of hydrochloric acid, chloric acid, perchloric acid or oxychloric compounds.

15. A process according to claims 5, wherein a final annealing is carried out heating the strip at an average heating rate of less than 12° C./hr at a temperature range of 800°–1100° C. in a heating stage, and performing high temperature final annealing at a temperature range of 1150°–1250° C.

* * * * *

UNITED STATES PATENT AND TRADEMARK OFFICE

CERTIFICATE OF CORRECTION

PATENT NO. : 5,685,920
DATED : November 11, 1997
INVENTOR(S) : Osamu Tanaka, et al.

It is certified that error appears in the above-identified patent and that said Letters Patent is hereby corrected as shown below:

Column 28,
Line 60, change "23" to -- ≦ --;

Column 30,
Line 30, change "claims 5" to -- claim 5 --;

Signed and Sealed this

Twenty fifth Day of September, 2001

*Attest:*

Nicholas P. Godici

NICHOLAS P. GODICI
*Acting Director of the United States Patent and Trademark Office*

*Attesting Officer*